US005575043A

United States Patent [19]

Candotti

[11] Patent Number: 5,575,043

[45] Date of Patent: Nov. 19, 1996

[54] BUTTON FOR CLOTHING

[76] Inventor: Riccardo Candotti, Via Roma, 83, 35100 Padova, Italy

[21] Appl. No.: 507,688

[22] Filed: Jul. 25, 1995

[30] Foreign Application Priority Data

Aug. 5, 1994 [IT] Italy ..... PD94A0146

[51] Int. Cl.[6] ..... A44B 1/18

[52] U.S. Cl. ..... 24/114.4; 24/103; 24/104; 24/108; 24/93; 24/691; 24/620; 24/621; 24/94; 24/95

[58] Field of Search ..... 24/103, 104, 108, 24/93, 691, 620, 621, 114.4, 94, 95

[56] References Cited

U.S. PATENT DOCUMENTS

| | | | |
|---|---|---|---|
| 488,219 | 12/1892 | Platt | 24/108 |
| 3,725,980 | 4/1973 | Burgio | 24/108 X |
| 4,481,696 | 11/1984 | Kanzaka | 24/108 X |
| 4,507,344 | 3/1985 | Baughman | 24/103 X |
| 4,512,063 | 4/1985 | Fukuroi | 24/94 |
| 4,541,148 | 9/1985 | Watanabe | 24/108 |
| 4,607,415 | 8/1986 | Fukuroi | 24/94 |
| 4,765,034 | 8/1988 | Kasai | 24/136 R |
| 4,928,362 | 5/1990 | Collas et al. | 24/94 X |
| 4,982,480 | 1/1991 | Kasai | 24/104 X |
| 5,016,368 | 5/1991 | Cassata | 24/108 X |

*Primary Examiner*—Peter M. Cuomo
*Assistant Examiner*—Stephen Vu
*Attorney, Agent, or Firm*—Guido Modiano; Albert Josif

[57] ABSTRACT

A button for clothing, comprising a metallic dome associated with an equally metallic bell-shaped part, which contains a core and is associable with the fabric of the item of clothing by means of a nail. The core is provided with a disk-shaped portion with which an axial stem is associated; the free end of the stem has a square cross-section and is force-fitted inside the bell-shaped part, which becomes complementarily shaped by plastic deformation at least at its corners, producing an association in which mutual rotation of the parts is prevented. The stem is provided with a blind axial channel for the engagement of the nail and the front surface of its end is provided with first raised portions adapted to engage the fabric and to cooperate with second raised portions that extend from the facing surface of the head of the nail.

18 Claims, 3 Drawing Sheets

BUTTON FOR CLOTHING

BACKGROUND OF THE INVENTION

The present invention relates to a button for clothing.

It is known that nowadays sports clothing especially requires buttons made of metallic material, or buttons that seem to be made of metal, fixed to the fabric without using thread.

Particularly items of clothing such as for example those made of jeans fabric, whether pants or jackets or shirts, but also made of other currently fashionable fabrics, use buttons formed by a dome associated with a bell-shaped part; these buttons are fixed to the fabric with a nail.

The dome, the bell-shaped part, and the nail are usually made of metal.

Although these buttons are extensively used and are rather durable and functional, they are not free from drawbacks.

In particular, the above mentioned buttons mainly have two drawbacks once they have been fixed to the fabric.

A first drawback arises from the fact that once the button has been fixed to the fabric, the bell-shaped part and the nail clamp the portion of fabric interposed therebetween; this clamping between the metallic edge of the bell-shaped part and the equally metallic surface of the nail can tear the fabric, thus causing the item of clothing to become unusable or in any case compromising its aesthetic and functional integrity, with the possibility of consequent separation of the button.

A second drawback arises from the fact that in a short time the nail and the bell-shaped part, due to chemical treatments and to washing with abrasive materials or due to the unavoidable plastic deformations produced during application and during use, tend to rotate with respect to one another, thus contributing to the wear and fraying of the edge of the cut hole on which they are fixed and of the surrounding fabric.

SUMMARY OF THE INVENTION

A principal aim of the present invention is to provide a button for clothing that solves the above discussed drawbacks of the conventional types.

In connection to this aim, an object of the present invention is to provide a button for clothing that drastically reduces the possibility of fabric breaking.

Another object of the present invention is to provide a button for clothing the production costs whereof are competitive with respect to those of conventional types.

Another object of the present invention is to provide a button for clothing that can be mass-produced with known technologies.

Another object of the present invention is to provide a button for clothing that achieves a good aesthetic result.

This aim, these objects, and others which will become apparent hereinafter are achieved by a button for clothing, of the type comprising a metallic dome associated with a bell-shaped part equally metallic, which contains a core and is associable with the fabric of the item of clothing by means of a nail, characterized in that said core is provided with a substantially disk-shaped portion with which an axial stem is associated, said stem having a square cross-section at least at its free end and being force-fitted inside said bell-shaped part, which becomes complementarily shaped by plastic deformation at least at the corners of its square portion, producing an association in which mutual rotation of the parts is prevented, said stem being furthermore provided with a blind axial channel for the engagement of said nail, the front surface of its end being provided with first raised portions adapted to engage the fabric and to cooperate with second raised portions that extend from the facing surface of the head of said nail.

BRIEF DESCRIPTION OF THE DRAWINGS

Further characteristics and advantages of the present invention will become apparent from the description of an embodiment thereof, illustrated only by way of non-limitative example in the accompanying drawings, wherein.

DESCRIPTION OF THE PREFERRED EMBODIMENTS

Figure 1:
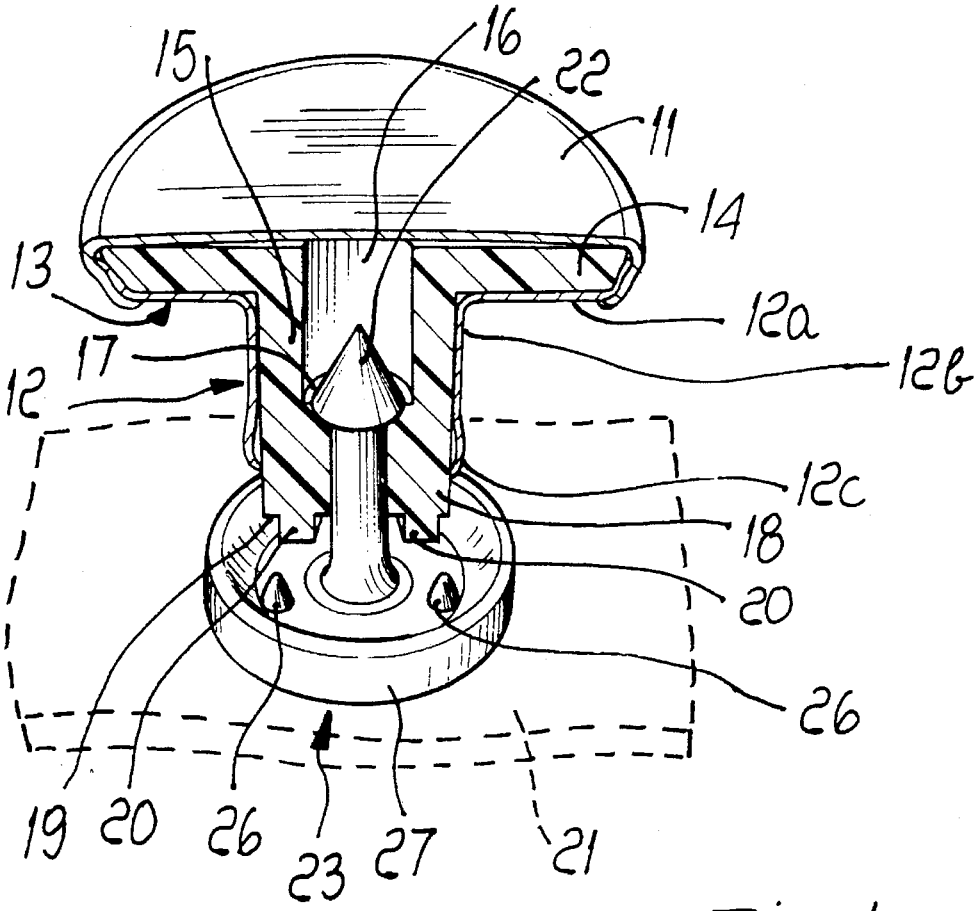
FIG. 1 is a partially sectional axonometric view of a button according to the invention.
Figure 2:
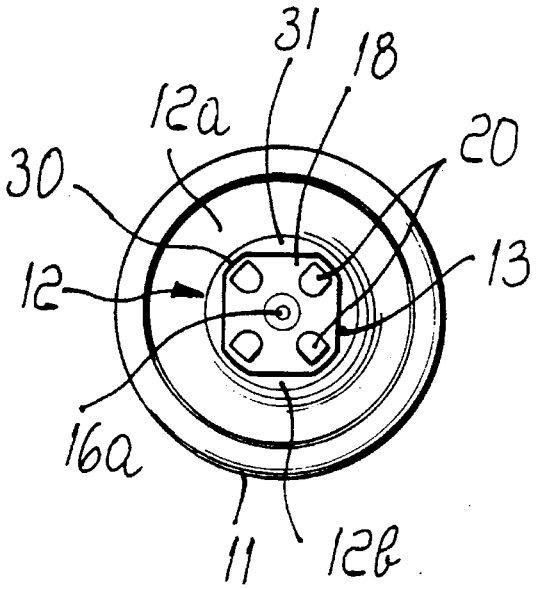
FIG. 2 is a bottom view of a detail of the button according to the invention.
Figure 3:
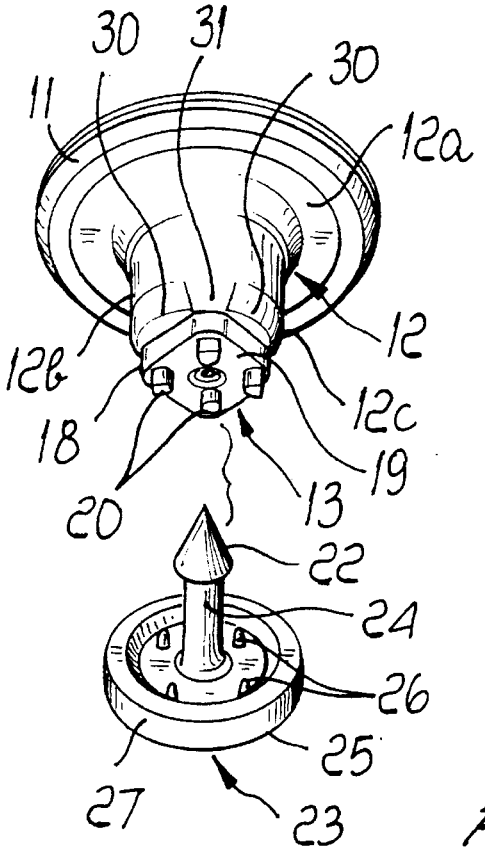
FIG. 3 is an exploded view of the button according to the invention.
Figure 4:
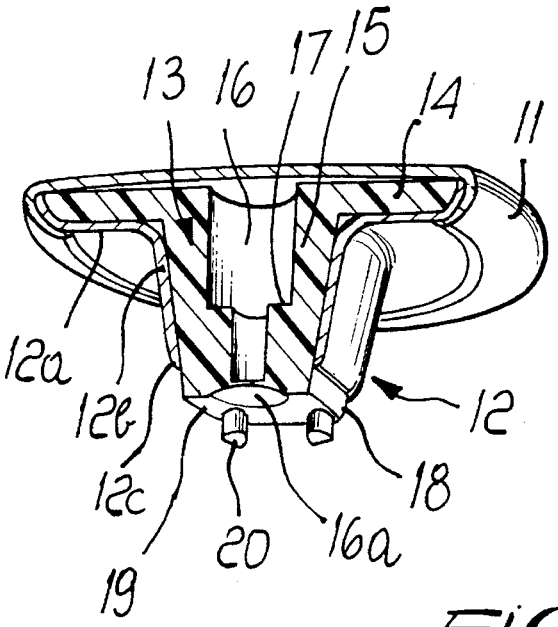
FIG. 4 is an axonometric sectional view of a detail, related to FIG. 2, of a button according to the invention.
Figure 5:
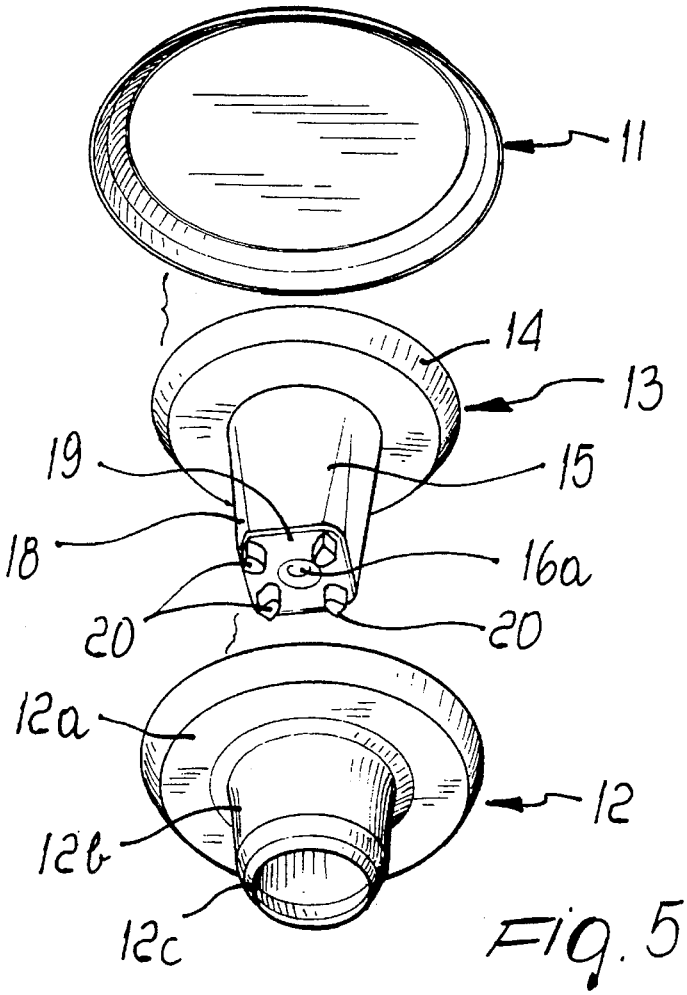
FIG. 5 is an exploded view of the button according to the invention.
Figure 6:
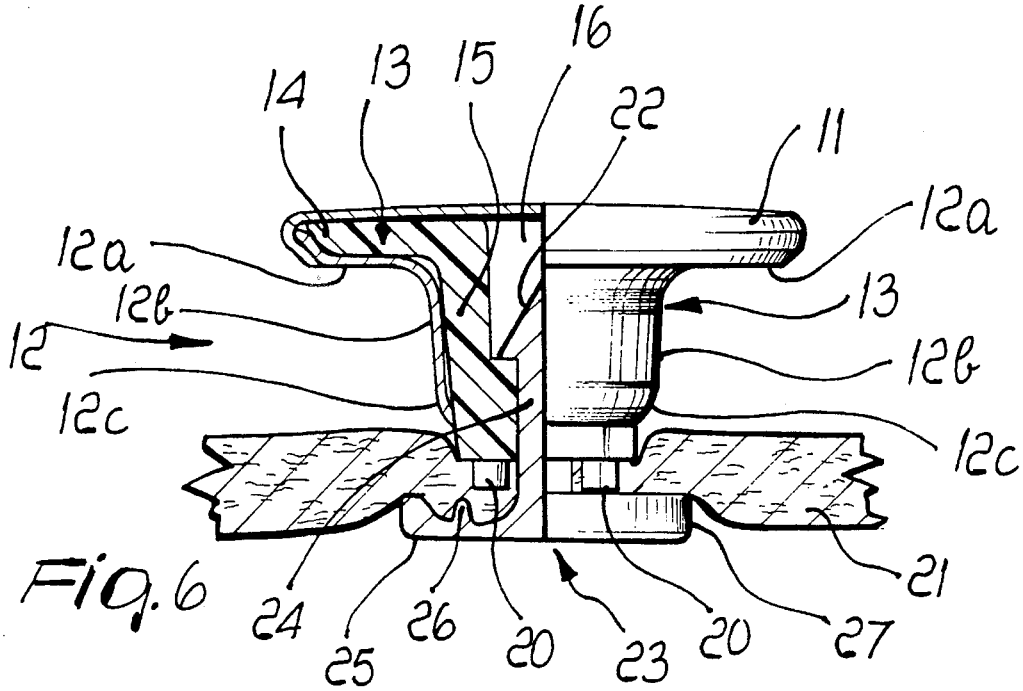
FIG. 6 is a partially sectional side view of the button according to the invention.

With reference to FIGS. 1 to 6, a button for clothing, according to the invention, is generally designated by the reference numeral 10.

The button 10 comprises a metallic dome 11 that is associated with a bell-shaped part 12 equally metallic, which has a flanged portion 12*a* and a tubular portion 12*b* that has a tapered region 12*c* related to the free end.

The metallic dome 11 and the bell-shaped part 12 are mutually associated by folding the edge of the dome over a corresponding edge of the part 12.

A core 13, made of plastic material having adequate mechanical strength such as nylon or the like, is contained in the hollow body constituted by the association of the metallic dome 11 and of the bell-shaped part 12; said core is constituted by a flange 14 and by an axial stem 15 that are formed monolithically.

In particular, the flange 14 is contained within the space generated by the dome 11 and by the flanged portion 12*a* of the bell-shaped part 12, whereas the stem 15 is inserted in the tubular portion 12*b*. It is seen that the tubular portion 12*b* and the axial stem 15 inserted therein form an axial central portion of the button, while a button flange portion, formed in this case by the flanged portion 12*a*, the flange 14, and the dome 11, depends from an end of the axial central portion of the button.

The core 13 furthermore has an axial channel 16 that is closed, prior to the fixing of the button 10 to the item of clothing, by a wall 16*a* at the free end of the stem 15 and is open at the flange 14.

The side wall of the axial channel 16 has an internal step 17.

The free end 18 of the stem 15 has a substantially square transverse cross-section and is longer than the bell-shaped part 12.

Once the free end 18 of the stem 15 has been inserted in the bell-shaped part 12, it protrudes therefrom and deforms it at the tapered region 12*c* so as to form therein regions 30 that are shaped complementarily at its corners.

Substantially arc-shaped regions 31, separated from the surface of the end 18 of the stem 15, remain between the corners.

Four first raised portions 20 extend from the front surface 19 of the end 18 and are arranged in a cross-like pattern.

As regards the already-mentioned wall 16*a*, said wall opens, when the button 10 is fixed to the fabric 21, under the action of the point 22 of a metallic nail 23.

In this manner, the wall 16*a*, by sliding and by slidingly interfering along the point 22 and the stem 24 of the nail 23, prevents the entry of thread strands into the axial channel 16 during the insertion of said nail 23.

The point 22 of the nail 23 is wider, at the base, than the portion of the channel 16 through which it must pass in order to engage the step 17; accordingly, its passage causes an elastic expansion of the stem 15 that affects the region 12*c* of the bell-shaped part 12, which compensates therefor elastically with the arc-shaped regions 31.

When the nail 23 is seated, the end 18 of the stem 15 and the region 12*c* regain their monolithic configuration.

The nail 23 has a head 25 provided with a surface that faces the end 18 of the stem 15 when coupled and from which four second raised portions 26, arranged in a cross-like pattern, and a raised edge 27 protrude.

The second raised portions 26, in addition to providing anchoring to the fabric 21, also cooperate with the raised edge 27, since when they are in the fixed position they are offset with respect to the first raised portions 20, forcing the fabric to assume a "ripply" shape once the button has been fixed.

In practice it has been observed that the intended aim and objects have been achieved.

In particular, the plastic deformation induced by the stem of the core 13 in the bell-shaped part 12 prevents any mutual rotation of these two parts; furthermore, the first raised portions 20, the second raised portions 26, and the raised edge 27 prevent mutual rotation of the button 10 and of the fabric 21 both directly and by cooperating with one another, It should also be noted that once the bell-shaped part 12 has received the core 13, which force-fits at the four corners, said bell-shaped part is also blocked axially with respect to said core 13; this is certainly an additional advantage with respect to conventional buttons.

It can also be noted that the fabric cannot become compressed between two metallic parts, consequently reducing the possibility of damage.

It should also be noted that an appreciable aesthetic result has been achieved as a whole without compromising the formal particularities that distinguish these kinds of button and cause them to be commercially appreciated.

The present invention is susceptible of numerous modifications and variations, all of which are within the scope of the inventive concept.

Furthermore, all the details may be replaced with other technically equivalent elements.

Thus, for example, the nail may also have a jagged point; the channel with two diameters provides a sort of receptacle for the point, which drags a chipped part therewith when it breaks the wall.

In practice, the materials employed, so long as they are compatible with the contingent use, as well as the dimensions, may be any according to the requirements.

What is claimed is:

1. A button for clothing fabric comprising:

a metallic dome;

a metallic bell-shaped part having a hollow tubular portion and a flanged portion depending from an end of said tubular portion, said flanged portion of said bell-shaped part being coupled with said dome;

a core contained in said hollow tubular portion of said bell-shaped part, said core having a disk-shaped portion and an axial stem connected to said disk-shaped portion at a first end of the stem, said stem having a square cross-section defining respective corners at least at a second free end thereof, the stem being further force-fitted inside said hollow tubular portion of said bell-shaped part which is complementarily shaped by plastic deformation at least at said corners of said stem for providing a coupling in which mutual rotation of said dome and said bell-shaped part is prevented and such that at least a portion of said second free end protrudes out of said hollow tubular portion, and said stem having a blind axial channel;

a nail being engageable in said axial channel;

first raised portions for engaging the fabric being provided on a front surface of said second end of said stem such that said first raised portions are positioned outside of said hollow tubular portion for engaging the fabric; and second raised portions protruding from a facing surface of a head of said nail, said first and second raised portions being mutually positioned for engaging said fabric such that in an engaged fixed configuration of the button said first and second raised portions are mutually axially offset and do not mutually engage.

2. Button for clothing fabric according to claim 1, wherein said stem has such a length as to protrude in a tapered end region of said hollow tubular portion of said bell-shaped part with its portion that has a square cross-section, deforming said hollow tubular portion of said bell-shaped part at its corners, said hollow tubular portion of said bell-shaped part having, in addition to regions that are shaped complementarily to said corners, four non-deformed regions being substantially arc-shaped and remaining separated form a lateral surface of said stem.

3. Button for clothing fabric according to claim 1, wherein said first raised portions comprise four raised portions and are arranged at four corners of a square.

4. Button for clothing fabric according to claim 1, wherein said second raised portions comprise four raised portions and are arranged at four corners of a square.

5. Button for clothing fabric according to claim 1, wherein said first raised portions and said second raised portions in an engaged fixed configuration of the button cooperate with a raised edge of the head of said nail, for giving a rippled shape to the fabric.

6. Button for clothing fabric according to claim 1, wherein said stem of said core has a wall that closes said axial channel prior to fixing to the fabric, said wall slidingly interfering with a surface of a point of the nail upon insertion of said nail in said axial channel.

7. Button for clothing fabric according to claim 6, wherein said axial channel comprises an internal discontinuity in its diameter in the form of a step in the inner wall of the axial channel, said step being adapted for engaging the point of said nail, a base portion of said point being wider than an entry portion of said axial channel through which it passes.

8. Button for clothing fabric according to claim 7, wherein the point of said nail is shaped as a simple cone.

9. Button for clothing fabric according to claim 7, wherein the point of said nail is jagged for forming a plurality of coaxial cones.

10. Button for clothing fabric according to claim 1, wherein said nail is made of metallic material.

11. Button for clothing fabric according to claim 1, wherein said core is made of a plastic material comprising nylon.

12. A button for attachment to fabric comprising:

a hollow tubular portion having a first end and a second end;

an axial stem accommodated inside said hollow tubular portion and having a first end and a second free end portion protruding from said second end of said hollow tubular portion;

wherein said hollow tubular portion and said axial stem form an axial central portion of the button and wherein the button further comprises:

a button flange portion connected to said axial central portion and arranged adjacent said first ends of said hollow tubular portion and said axial stem;

a head connectable to said axial central portion in a manner such that the fabric is arranged between the head and the second free end portion of the axial stem in an engaged fixed configuration of the button;

a first raised protruding structure provided on said second free end portion of said axial stem such that said first raised protruding structure is positioned outside of said hollow tubular portion for engaging the fabric; and a second raised protruding structure provided on said head such that said first and second raised protruding structures are mutually axially offset and do not mutually engage but engage instead with opposite surfaces of the fabric in the engaged fixed configuration of the button to form a rippled configuration of the fabric.

13. The button of claim 12 wherein said hollow tubular portion is made of metallic material and said axial stem is made of plastic material.

14. The button of claim 12 wherein said stem is force-fitted inside said hollow tubular portion for preventing mutually rotation between said stem and said hollow tubular portion.

15. The button of claim 14 further comprising means for force-fitting said stem inside said hollow tubular portion.

16. The button of claim 12 further comprising means for connecting said head to said axial central portion.

17. The button of claim 12 further comprising means for defining said first and second raised protruding structures.

18. The button of claim 12 further comprising a protruding circumferential portion provided on said head for cooperating with said first and second raised protruding structures in forming the rippled configuration of the fabric.

* * * * *